US005469482A

United States Patent [19]

Vandenberg et al.

[11] Patent Number: 5,469,482

[45] Date of Patent: Nov. 21, 1995

[54] SPLINE COUNTING MECHANISM

[75] Inventors: Douglas Vandenberg, St. Charles; Michael L. Philpott, Champaign; Phillip A. Green, Crystal Lake; Scott A. Eastman, Urbana; Sean M. Carlini, Rockford, all of Ill.

[73] Assignees: Aircraft Gear Corporation, Rockford; The Board of Trustees of the University of Illinois, Urbana, both of Ill.

[21] Appl. No.: 315,071

[22] Filed: Sep. 29, 1994

[51] Int. Cl.[6] ..... G06M 1/02; G06M 1/276

[52] U.S. Cl. ..... 377/3; 377/17; 235/103

[58] Field of Search ..... 377/3, 17; 235/103

[56] References Cited

U.S. PATENT DOCUMENTS 3,991,702 11/1976 Taylor ..... 235/103

4,233,592 11/1980 Leichle ..... 377/17

4,257,324 3/1981 Stephansson et al. ..... 377/3

*Primary Examiner*—John S. Heyman

*Attorney, Agent, or Firm*—Leydig, Voit & Mayer, Ltd.

[57] ABSTRACT

A spline counting mechanism for determining the number of splines on a shaft. The spline counting mechanism includes a plunger urged into engagement with the shaft and adapted to be rotated with respect to the shaft. The plunger is adapted to engage each spline on the shaft as the plunger is rotated through one revolution and is operable to establish and cut off electrical continuity in an electrical circuit as the plunger rotates into engagement with and then beyond each spline. The mechanism further includes a digital counter for counting and displaying the number of times that electrical continuity is established in the electrical circuit, this number being equal to the number of splines on the shaft.

22 Claims, 4 Drawing Sheets

SPLINE COUNTING MECHANISM

BACKGROUND OF THE INVENTION

This invention relates generally to a mechanism for determining the number of splines on a shaft and, more specifically, to a mechanism which is especially adapted for counting the number of splines on a shaft independently of the major diameter of the splines.

Many types of malfunctioning automotive assemblies such as constant velocity or CV joints are rebuilt or refurbished for subsequent use. The splined shafts used in these assemblies are frequently returned to a rebuild shop without identification regarding the manufacturer or the model of the shaft. One of the first steps in determining the source of the splined shaft is to determine the number of splines on the shaft and the major diameter of the splines. With the aid of a caliper or a micrometer, determining the major diameter of the splines is relatively easy. A spline gage may be used to determine the number of splines on a shaft. However, due to the wide variety of splined shaft designs that may be encountered, purchasing gage tooling for each size of spline that may be encountered is prohibitively expensive. At present, the only economically viable procedure to determine the number of splines on any one of several shafts having differently sized splines is to manually count the splines.

SUMMARY OF THE INVENTION

The general aim of the present invention is to provide a new and improved mechanism which is capable of automatically counting the number of splines on a shaft.

Another related objective of the invention is to provide a spline counting mechanism which is operable on shafts having splines with different major diameters and which visually indicates the major diameter of such splines.

A more detailed objective of the invention is to provide a plunger which engages each spline on the shaft as the spline counting mechanism is rotated through one revolution relative to the shaft and which is operable to establish and then to cut off electrical continuity in an electrical circuit as the plunger is rotated into engagement with and then beyond each spline.

Another more detailed objective of the invention is to provide a digital counter which is operable to count and to display the number of times that electrical continuity is established in the electrical circuit, this number being equal to the number of splines on the shaft.

A related and more detailed objective of the invention is to provide locking means which restricts free rotation of the plunger to one revolution.

These and other objects and advantages of the invention will become more apparent from the following detailed description when taken in conjunction with the accompanying drawings.

Figure 1:
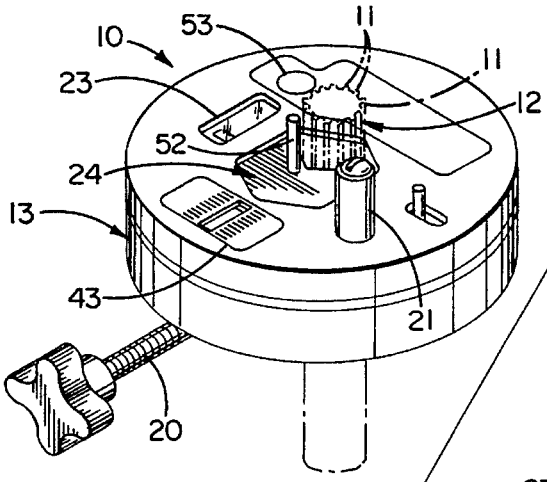
FIG. 1 is a perspective view of a new and improved spline counting mechanism incorporating the unique features of the present invention and shows a splined shaft secured in the mechanism.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

For purposes of illustration, the present invention is shown in the drawings as embodied in a portable spline counting mechanism 10 (FIG. 1) which is suitable for determining the number of splines 11 on a shaft 12.

Figure 2:
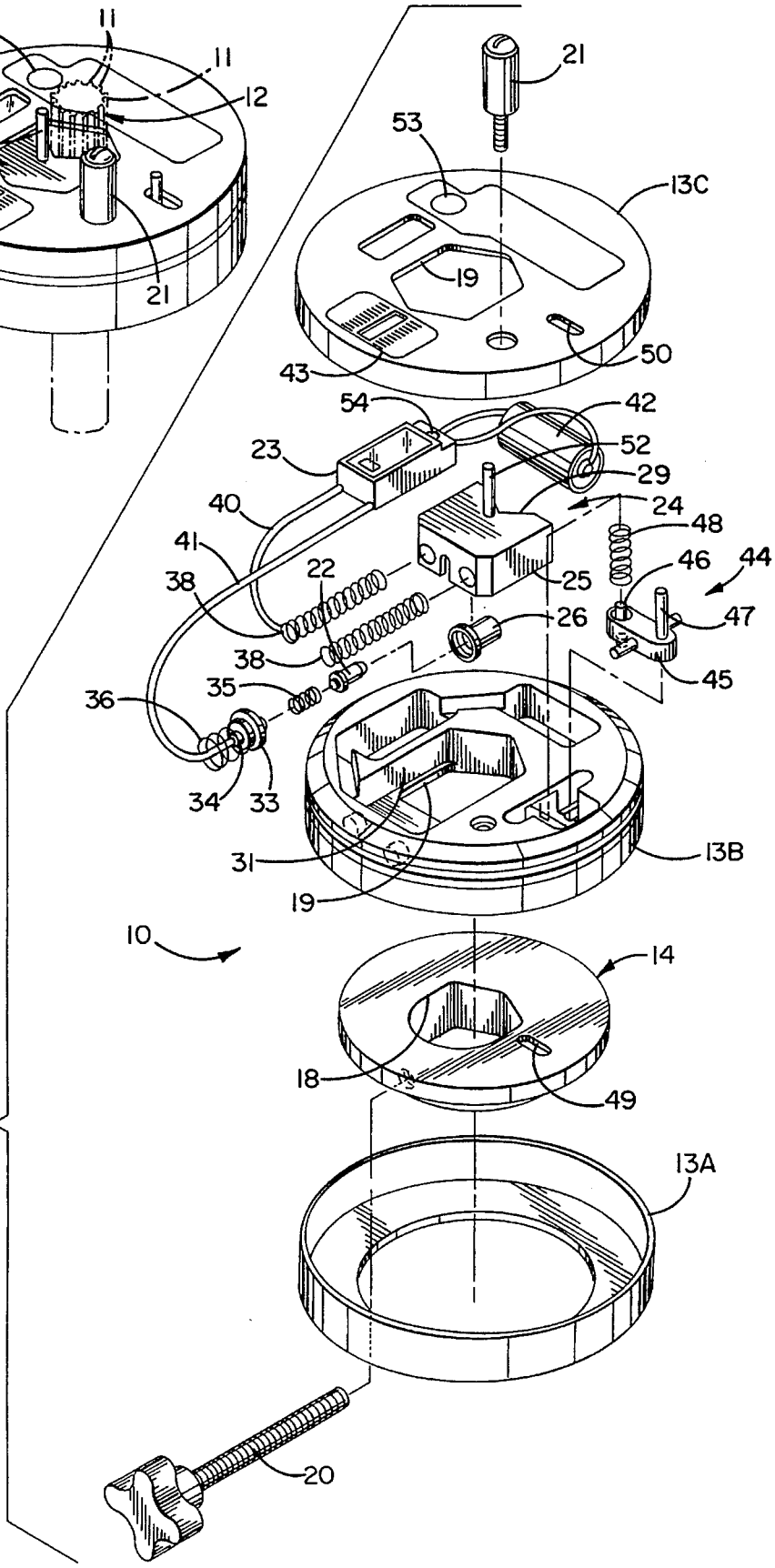
FIG. 2 is an exploded perspective view of the spline counting mechanism.
Figure 5:
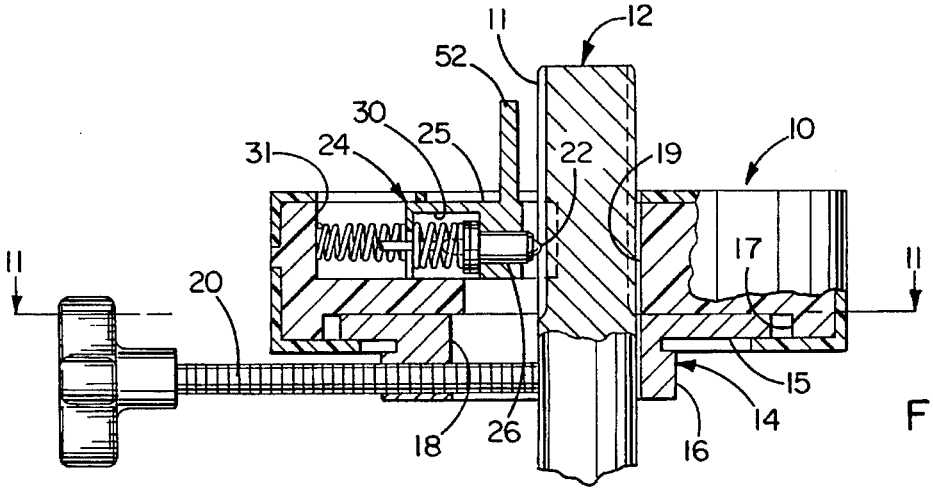
FIG. 5 is a fragmentary cross-sectional view taken substantially along the line 5—5 of FIG. 3.

The spline counting mechanism 10 includes a housing 13 and a base member 14 (FIG. 2) which is rotatable with respect to the housing. The housing is made by bonding three molded plastic sections 13A, 13B, and 13C together. The base 14 includes a flange 15 (FIG. 5) which extends radially outwardly from the upper end of a collar 16. The flange 15 is captured axially by and is capable of rotating in a radially extending groove 17 defined between the lower housing section 13A and the middle housing section 13B. Internal components (discussed below) are trapped between the middle housing section 13B and the upper housing section 13C.

The shaft 12 is received in an opening 18 in the base 14 and is positioned with at least a portion of the splines 11 extending through an opening 19 in the housing 13. The shaft is secured in the base by a clamping screw 20 so that the shaft is rotatable with respect to the housing. During normal use of the spline counting mechanism 10, either the shaft or the housing is held in place and the other is rotated. In the embodiment illustrated, the shaft is securely held in place in, for example, a vise (not shown) and the housing is manually rotated with respect to the shaft. A knob 21 (FIG. 2) is secured to the housing to facilitate manual rotation of the housing.

In accordance with one aspect of the invention, the spline counting mechanism 10 includes a pickup pin or plunger 22 (FIG. 6) which slidably engages each spline 11 as the housing 13 is rotated and which is operable to generate and cutoff an electrical signal in an electrical circuit as the plunger engages and is rotated beyond each spline. As a result, the number of splines on the shaft 12 is equal to the number of times that the electrical signal is generated in the electrical circuit. The spline counting mechanism further includes a digital counter 23 which is operable to count and visually display the number of times the electrical signal is generated so as to indicate the number of splines on the shaft.

More specifically, the spline counting mechanism 10 includes a slider assembly 24 having an aluminum body 25, a generally cylindrical brass or bronze casing 26, and the generally cylindrical plunger 22. The plunger is made from hardened corrosion-resistant steel. The plunger is slidably received in an opening 27 formed in the casing which, in turn, is slidably received in an opening 28 formed in the body. The openings 27 and 28 extend radially with respect to the shaft 12. As a result, the casing and the plunger are radially moveable with respect to the shaft. The end 22A of the plunger adjacent the shaft is defined by a rounded tip which is adapted to slide along the profile of each spline 11 as the housing 13 is rotated. The end 26A (FIG. 7) of the casing adjacent the shaft is formed with a flat surface which is adapted to ride on the crowns of the splines as the housing is rotated.

Figure 3:
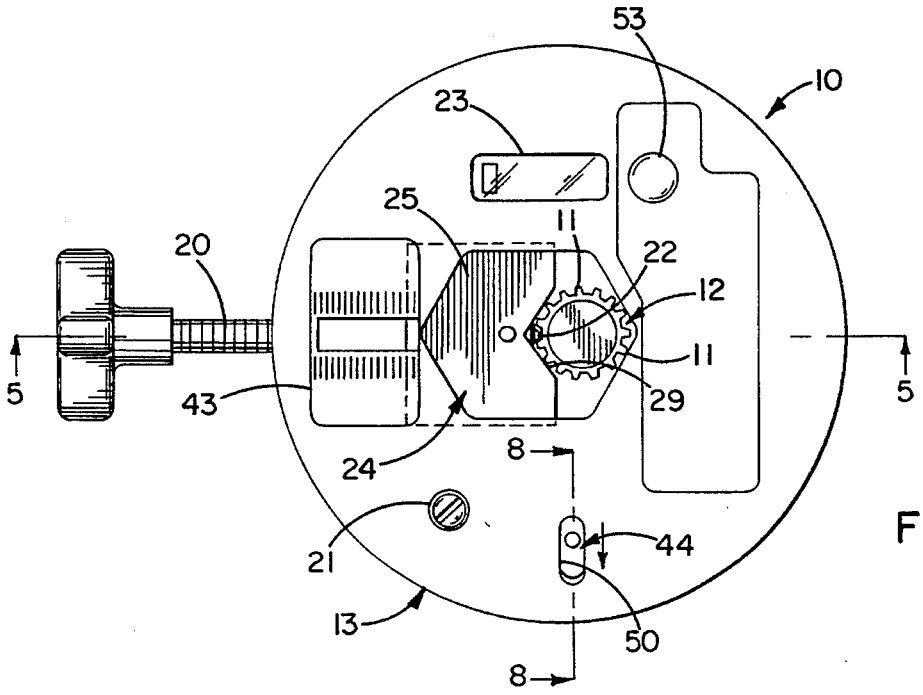
FIG. 3 is a top view of the spline counting mechanism.
Figure 4:
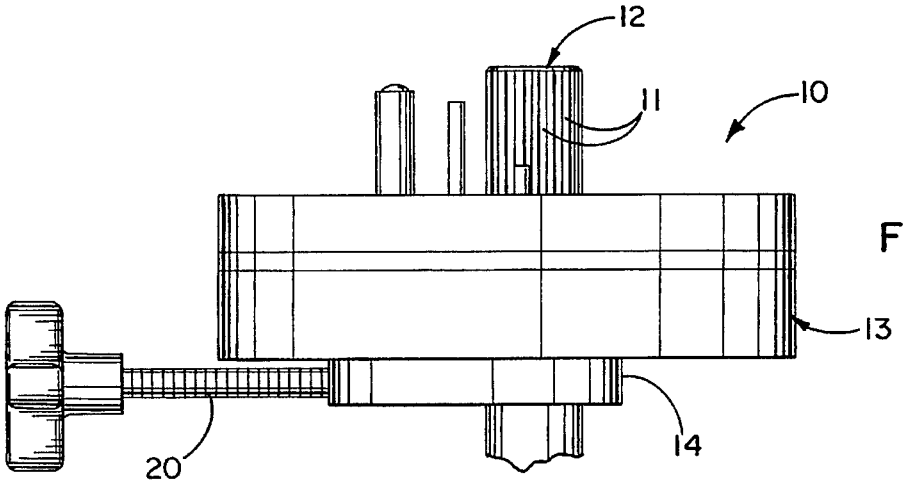
FIG. 4 is a side view of the spline counting mechanism.

The body 25 is formed with a V-shaped end 29 (FIG. 3) adjacent the splined portion of the shaft 12. The opening 28 extends from the end 29 of the body to a cavity 30 (FIG. 6) formed in the body. The body is slidably received in a slot 31 formed in the middle housing section 13B and is trapped between the middle housing section 13B and the upper housing section 13C. The slot extends radially from and is partially defined by the opening 19 in the housing. In this way, the body, and therefore the entire slider assembly, is rotatable with the housing and radially moveable with respect to the shaft.

A flange 26B (FIG. 6) formed at the end of the casing 26 is located in the cavity 30 and is adapted to engage a sidewall of the cavity so as to restrict movement of the casing toward the shaft 12. A flange 22B formed near the end of the plunger 22 is adapted to engage the end 26C of a counterbore formed in the casing so as to restrict movement of the plunger toward the shaft. As a result, the plunger is slidably retained in the slider assembly 24. With a shaft 12 installed in the spline counting mechanism 10, the flanges 26B and 22B are normally separated from the cavity sidewall and the end 26C, respectively. The slider assembly further includes a contact cap 33 made from an electrically insulating plastic. The contact cap is located in the cavity and is adapted to engage the flange 26B of the casing.

A spring 35 is located. between and engages the contact cap 33 and the plunger 22. The spring 35 urges the plunger toward the shaft 12 so that the end 22A of the plunger normally projects beyond the end 26A of the casing 26. A second spring 36 engages the contact cap and the backwall of the body 25 and urges the contact cap into engagement with, the casing. In addition, the spring 36 urges the contact cap and the casing toward the shaft so that the end 26A of the casing normally extends beyond the end 29 of the body 25 and slidably engages the crowns of the splines 11. At least one and preferably a pair of springs 38 is located in the slot 31, radially outwardly of the body and engage the body. The springs 38 also engage the backwall of the slot 31 to urge the entire slider assembly 24 toward the shaft 12 and to urge the V-shaped end 29 of the body into engagement with the splined portion of the shaft.

Figure 6:
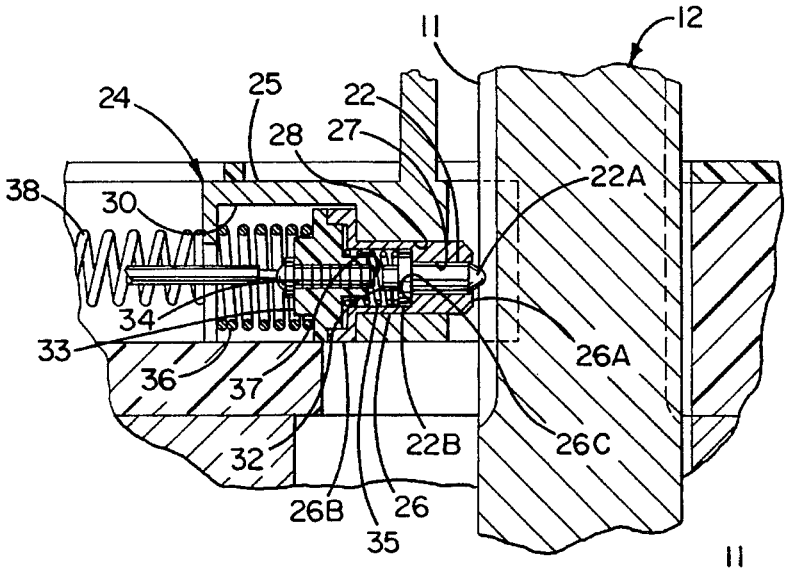
FIG. 6 is an enlarged view of certain parts shown in FIG. 5.
Figure 7:
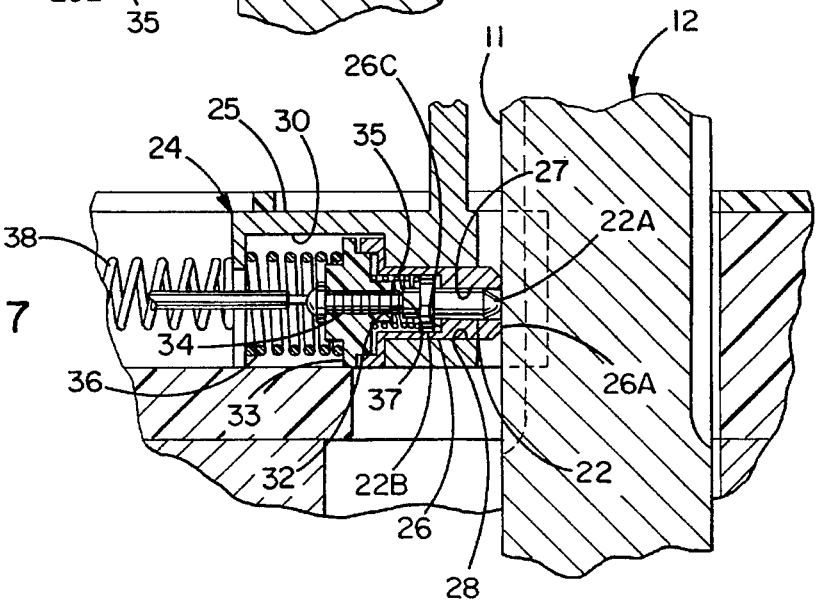
FIG. 7 is a view similar to FIG. 6 but shows the plunger engaging a spline on the shaft.

With the foregoing arrangement, the plunger 22 is operable to move radially inwardly and outwardly with respect to the shaft 12 between inner and outer positions, respectively, as the housing 13 is rotated. More specifically, the plunger moves to its inner position when the end 22A of the plunger is angularly aligned with the root between two adjacent splines 11 (FIG. 6). The spring 35 urges the plunger toward its inner position. The plunger is moved to its outer position when the plunger is in contact with the crown of a spline (FIG. 7). As the plunger is rotated with the housing, a spline engages the end 22A of the plunger and drives the plunger from its inner position to its outer position as the end of the plunger slides along the spline profile. As the plunger rotates beyond the spline, the spring 35 returns the plunger to its inner position.

The spline counting mechanism is uniquely configured so that the opening 19 in the housing 13 is self-aligning with the opening 18 in the base 14. The outside diameter of the flange 15 is substantially smaller than the inside diameter of the groove 17 formed in the housing. As a result, the housing is radially moveable with respect to the opening 18 and with respect to the shaft which is held firmly in the opening 18 by the clamping screw 20. By virtue of the location of the springs 38, they act on the housing 13 as well as on the body 25. As the springs 38 drive the V-shaped end 29 of the body into engagement with the splined portion of the shaft 12 in one direction, the springs simultaneously draw the V-shaped end of the opening 19 into engagement with the shaft from the opposite direction. The V-shaped profiles on the body and on the opening 19 aid in aligning the housing with the shaft. As a result, the plunger 22 and the slider assembly 24 automatically align with the splined portion of the shaft independently of the major diameter of the splines 11. These provisions for automatically aligning the opening 19 in the housing with the shaft also avoid the need for closely toleranced alignment bearings between the base and the housing.

Figure 10:
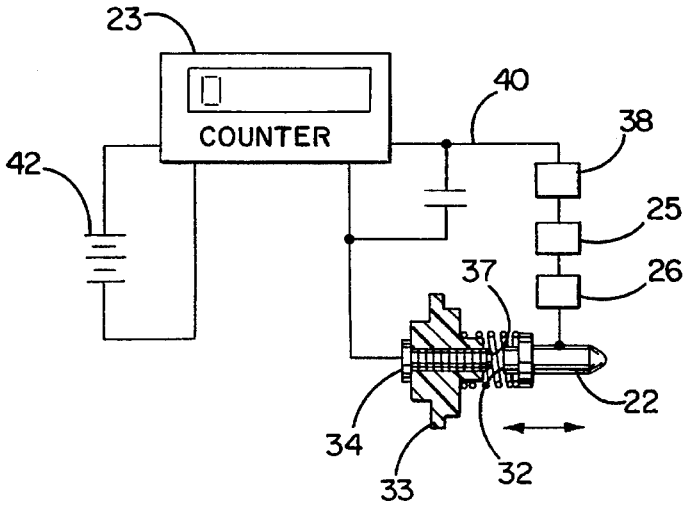
FIG. 10 is an electrical schematic of the spline counting mechanism.
Figure 11:
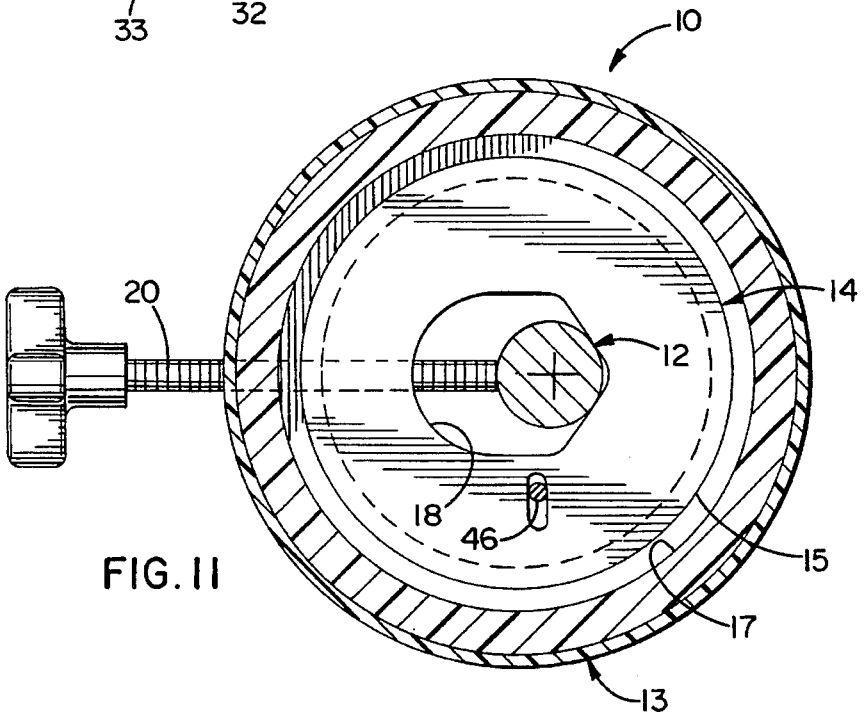
FIG. 11 is a cross-sectional view taken substantially along the line 11—11 of FIG. 5.

In the preferred embodiment, the body 25, the casing 26, the plunger 22, and one of the springs 38 are electrically conductive and define, in part, one side of the electrical circuit (FIG. 10). A wire 40 is soldered to one of the springs 38 to establish electrical continuity between the spring and the counter 23. The springs 38 are seated against the body so that electrical continuity is established between the wire 40 and the body. Electrical continuity is established between the body and the casing by virtue of line-to-line surface contact between the opening 28 and the outside surface of the casing. The first side of the electrical circuit is completed by the line-to-line sliding contact between the opening 27 in the casing and the outside surface of the plunger. The end of the plunger 22 opposite the end 22A defines an electrical contact surface 32.

An electrical contact 34 is carried by the electrically insulating contact cap 33 and is aligned with the plunger 22. A second electrical contact surface 37 is defined on the end of an electrical contact 34 adjacent the contact surface 32. The second side of the electrical circuit is completed by connecting a second electrical wire 41 between the counter 23 and the contact 34.

In the preferred embodiment, the two sides of the electrical circuit are normally isolated from each other and an electrical signal is generated when electrical continuity is established between the two sides of the circuit. The two sides of the electrical circuit are normally isolated by the spring 35, which normally separates the electrical contact surfaces 32 and 37, and by the contact cap 33 which electrically insulates the contact 34 from the casing 26. Electrical continuity is established in the electrical circuit when the plunger moves to its outer position so that the first electrical contact surface 32 engages the second electrical contact surface 37. A battery 42 supplies electrical power to the counter 23 and the electrical circuit. To facilitate portability of the spline counting mechanism 10, all of the components in the electric circuit, including the battery, are secured between the middle housing section 13B and the upper housing section 13C for rotation with the housing 13.

With the foregoing arrangement, the plunger 22 is operable to establish and cut off electrical continuity in the electrical circuit as the plunger moves between its outer and inner positions. As the plunger is driven to the outer position by a spline 11, the plunger overcomes the force of the spring 35 to enable the electrical contact surface 32 to engage the electrical contact surface 37 on the contact 34. As a result, the plunger establishes electrical continuity in the electrical circuit as the plunger rotates into engagement with each spline. Additionally, as the plunger rotates beyond the spline, the spring 35 returns the plunger to its inner position, separating the electrical contact surfaces and cutting off electrical continuity in the electrical circuit.

In carrying out the invention, the electrical contact surfaces 32 and 37 engage before the crown of a spline 11 becomes fully aligned with the plunger 22. This arrangement insures that the electrical contact surfaces engage for splines having different heights. During use of the spline counting mechanism, a spline initially drives the plunger against the spring 35 until the electrical contact surfaces engage. However, to avoid damage to the plunger and to the contact 34 as the spline continues to drive the plunger, the second electrical contact surface 37 is moveable by the first electrical contact surface 32. Specifically, as the spline continues to drive the. plunger outwardly, the plunger separates the contact cap 33 from the flange 26B of the casing 26 and drives against the spring 36 until the crown of the spline is aligned with the plunger.

Figure 8:
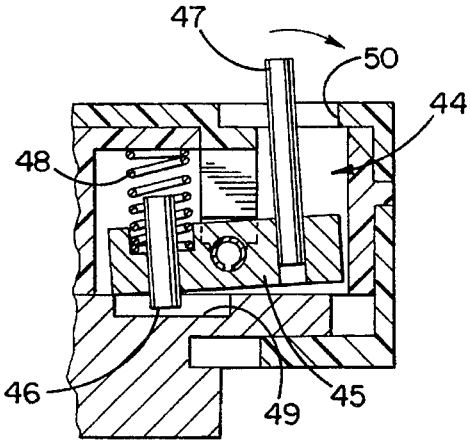
FIG. 8 is an enlarged fragmentary cross-sectional view taken substantially along the line 8—8 of FIG. 3.
Figure 9:
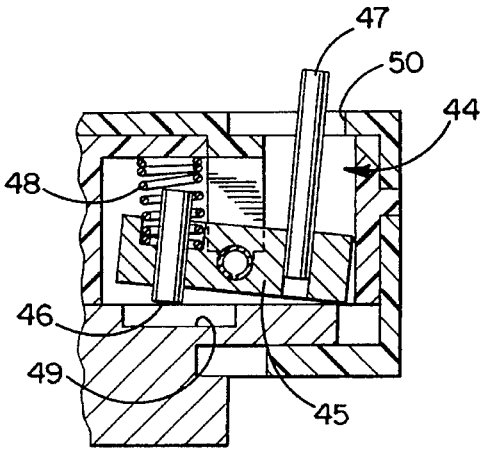
FIG. 9 is a view similar to FIG. 8 but shows a locking mechanism in a released position.

Further in carrying out the invention, a locking mechanism 44 (FIG. 8) normally locks the housing 13 and the shaft 12 in a predetermined relative position to normally prevent rotation of the housing with respect to the shaft. In this way, the housing and the shaft are normally stationary relative to one another. The locking mechanism is operable to permit 360 degrees of uninterrupted rotation, i.e., one revolution, of the housing after the locking mechanism has been released. The locking mechanism automatically re-locks, to prevent further rotation of the housing at the completion of one revolution of the housing, until the mechanism is again released. The locking mechanism includes a rocker arm 45 which is pivotally mounted in the middle housing section 13B. A locking pin 46 is secured into an opening at one end of the rocker arm and projects downwardly from the rocker arm. An actuating pin 47 is secured into an opening at the opposite end of the rocker arm and projects upwardly through a slot 50 formed in the upper housing section 13C. A spring 48 normally urges the end of the locking pin 46 downwardly and into a slot 49 formed in the base so that rotation of the housing with respect to the base is normally prevented.

The locking mechanism 44 may be released by pressing downwardly on the actuating pin 47 and then rotating the housing 13. When the actuating pin is pressed downwardly, the rocker arm 45 pivots against the force of the spring 48 and raises the locking pin 46 out of the slot 49. At this point, the housing may be freely rotated. After the housing 13 has been rotated a few degrees, the locking pin rotates out of alignment with the slot 49. The actuating pin may then be released and the locking pin will slide on the upper surface of the base 14 as the housing is rotated. When the locking pin realigns with the slot 49 at the completion of one revolution of the housing, the spring 48 causes the locking pin to drop back into the slot, automatically re-locking the locking mechanism 44 and preventing further rotation of the housing.

With the foregoing arrangement, the spline counting mechanism 10 is operable to automatically count the number of splines 11 on a shaft 12 as the housing 13 is manually rotated through one revolution. As the shaft is installed in the openings 18, 19, the slider assembly 24 may be slid outwardly in the slot 31 by pressing outwardly on a post 52 which is secured to the body 25. The shaft is initially secured in the opening 18 with the plunger 22 located between two adjacent splines (FIG. 6). In this position, the electrical contact surfaces 32 and 37 are separated. The counter 23 is reset to zero by pressing on a button 53 (FIG. 1) which is integrally molded in the upper housing section 13C. The button 53 includes an integrally molded plastic post (not shown) which projects downwardly from the lower surface of the upper housing section 13C and which engages a reset button 54 (FIG. 2) on the counter. To determine the number of splines, the locking mechanism 44 is released and the housing is smoothly and continuously rotated until the locking mechanism prevents further rotation. As the housing is rotated through one revolution, the digital counter 23 counts and visually indicates the number of times electrical continuity is established in the electrical circuit, this number being equal to the number of splines on the shaft.

Further in accordance with the present invention, a predetermined distance is maintained between the second electrical contact surface 37 and the crowns of the splines 11 independently of the major diameter of the splines 11 on the shaft 12. Additionally, the length of the plunger 22 is greater than this predetermined distance. As a result, the spline counting mechanism 10 is operable to determine the number of splines on differently sized splines.

The V-shaped end 29 of the body 25 normally rests against the splined portion of the shaft 12 and the crowns of the splines slidably contact each side of the V-profile. The casing 26 normally projects from the center of the V-shaped end and slidably engages the crowns of the splines 11. As a result, the position of the casing 26 changes with respect to the body as the major diameter of the splines 11 change. Specifically, as the major diameter increases, the splines engage the sides of the V-shaped end further outwardly from the center. Similarly, as the major diameter decreases, the splines engage the sides of the V-shaped end further inwardly or closer to the center. Alternately stated, the shaft is received further into the V-shape as the major diameter of the splines decreases. Therefore, the casing is driven further inwardly with respect to the body as the major diameter of the splines decreases.

In carrying out the invention, the contact cap 33 is fixed with respect to the casing 26 in the sense that they move radially together as the position of the casing changes relative to the body 25 due to a change in the major diameter of the splines 11. More specifically, the spring 36 urges the contact cap into engagement with the flange 26B of the casing and urges the end 26A of the casing into engagement with the splines, so as to establish a predetermined distance between the second electrical contact surface 37 and the crowns of the splines. Therefore, as the casing position changes with respect to the body, the spring 36 maintains this predetermined distance. As a result, the second electrical contact is automatically positioned with respect to the crowns of the splines. Since the length of the plunger is greater than this predetermined distance, the plunger is operable to establish and cut off electrical continuity in the electrical circuit independently of the major diameter of the splines.

Advantageously, the spline counting mechanism 10 includes a scale 43 (FIG. 3) to visually indicate the major diameter of the splines 11 on the shaft 12. The scale 43 is mounted on the upper surface of the housing 13 adjacent a slot 55 formed in the upper housing section 13C. The slot 55 is formed parallel with the slot 31 and adjacent the slider assembly 24 so that a portion of the body 25 is visible through the slot 55. The graduations on the scale are marked so that the major diameter of the splines on the shaft is visually indicated by the marking of the graduation that is aligned with the back surface of the body 25 when the shaft is secured in the spline counting mechanism 10.

From the foregoing, it will be apparent that the present invention brings to the art a new and improved spline counting mechanism 10 which is capable of automatically counting the number of splines on a shaft as the mechanism is simply rotated through one revolution. By virtue of the unique construction of the slider assembly 24, the spline counting mechanism is capable of counting the number of splines on a shaft independently of the major diameter of the splines. As a result, splined shafts may be quickly and easily identified and sorted as to the number of splines on the shaft and as to the size of the splines.

We claim:

1. A mechanism for determining the number of splines on a shaft member, said mechanism comprising a housing member, means for rotating one of said members relative to said other member, means for normally locking said one member in a predetermined position with respect to said other member whereby said one member is normally stationary relative to said other member, means for releasing said locking means whereby said one member may be freely rotated through one revolution whereupon said locking means automatically re-locks, means for automatically counting the number of splines on said shaft member as said one member is rotated through one revolution, and means for displaying the number of splines on said shaft member after said one member has rotated through one revolution.

2. A mechanism as recited in claim 1 further comprising means for automatically positioning said counting means with respect to said splines independently of the major diameter of said splines whereby said counting means are operable on differently sized shaft members.

3. A mechanism as recited in claim 2 wherein said positioning means includes a body moveable radially of said splines and having a v-shaped end, said positioning means further comprising a spring for urging said v-shaped end into engagement with said splines.

4. A mechanism as recited in claim 1 wherein said counting means includes means for slidably engaging said splines as said one member is rotated relative to said other member.

5. A mechanism as recited in claim 4 wherein said engaging means comprise a casing and a plunger, said casing and said plunger being moveable with respect to said shaft member, said plunger having a first end operable to engage the crown of each spline as said one member is rotated through one revolution, said casing being normally urged into engagement with the crown of said splines, and wherein said counting means further includes first and second electrical contact surfaces, said first electrical surface being connected to said plunger for movement with said plunger whereby a first predetermined distance is established between said first end and said first electrical contact, said second electrical contact surface being connected to said casing for movement with said casing whereby a second predetermined distance is established between said second electrical contact surface and the crown of said splines, said electrical contact surfaces being operable to engage each time said first end engages a spline, said counting means being operable to count the number of times said electrical contacts engage, and said first predetermined distance being greater than said second predetermined distance whereby said counting means is operable to count splines independently of the major diameter of said splines.

6. A portable mechanism for determining the number of splines on a shaft, said mechanism comprising a housing, means for rotating said housing relative to said shaft, means for normally locking said housing in a predetermined position with respect to said shaft whereby said housing is normally prevented from rotating relative to said shaft, means for releasing said locking means whereby said housing may be freely rotated through one revolution whereupon said locking means automatically re-locks, and means for counting and displaying the number of splines on said shaft as said housing is rotated through one revolution, said counting and displaying means including a battery secured to said housing for rotation with said housing.

7. A mechanism as recited in claim 6 further comprising means for automatically positioning said counting means with respect to said splines independently of the major diameter of said splines whereby said counting means are operable on differently sized shafts.

8. A mechanism for counting the number of angularly spaced splines on a shaft member, said mechanism comprising an electrical circuit, a plunger member, means for urging said plunger member toward said shaft member, said plunger member being movable radially of said shaft member between inner and outer positions, said plunger member being in said inner position when aligned angularly with the root between two adjacent splines and being in said outer position when in contact with the crown of a spline, said plunger member being operable to generate an electrical signal in said circuit when said plunger member is in said outer position and being operable to cut off said electrical signal when said plunger member is in said inner position, means for rotating one of said members with respect to the other of said members whereby each spline engages and drives said plunger member from said inner position to said outer position so as to generate said electrical signal in said electrical circuit as each spline aligns with said plunger member, said urging means causing said plunger member to move from said outer position to said inner position so as to cut off said electrical signal as said plunger aligns with the root between two adjacent splines, means for normally locking said one member in a predetermined position with respect to said other member whereby said one member is normally stationary relative to said other member, means for releasing said locking means whereby said one member may be freely rotated through one revolution whereupon said locking means automatically re-locks, and means for counting and displaying the number of times said electrical signal is established in said circuit whereby the number of times said electrical signal is established as said one member travels through one revolution is equal to the number of splines on said shaft member.

9. A mechanism as recited in claim 8 wherein said plunger member is electrically conductive and said electrical circuit includes said plunger member.

10. A mechanism for counting the number of angularly spaced splines on a shaft, said mechanism comprising a housing, means for rotating said housing with respect to said shaft, a plunger, means for securing said plunger for rotation with said housing while permitting said plunger to be movable radially of said shaft between inner and outer positions, said plunger being in said inner position when said plunger is located angularly between two adjacent splines and being in said outer position when in contact with the crown of each spline, means for urging said plunger toward said inner position, an electrical circuit having a first electrical contact surface moveable with said plunger and a second electrical contact surface, said electrical contact surfaces engaging to establish electrical continuity in said circuit when said plunger is in said outer position and separating when said plunger is in said inner position, and means for counting and displaying the number of times electrical continuity is established between said electrical contact surfaces whereby the number of times electrical continuity is established as said housing travels through one revolution is equal to the number of splines on said shaft.

11. A mechanism as recited in claim 10 wherein said plunger is electrically conductive and said electrical circuit further includes said plunger.

12. A mechanism as recited in claim 10 further comprising a base having an opening adapted to slidably receive said shaft and having a radially extending flange, and means for securing said shaft in said opening, and wherein said housing is formed with a radially extending groove adapted to receive said flange, said flange being secured in said groove for rotation relative to said housing.

13. A mechanism as recited in claim 10 further comprising means for normally locking said housing in a predetermined position with respect to said shaft whereby said housing is normally prevented from rotating relative to said shaft, and means for releasing said locking means whereby said housing may be freely rotated through one revolution whereupon aid locking means automatically re-locks.

14. A mechanism as recited in claim 13 wherein said base is formed with a second opening, and wherein said restricting means comprise a pin movably secured to said housing, said pin having a first position defined when said pin is partially located in said second opening to prevent rotation of said housing and having a second position defined when said pin is removed from said second opening to permit rotation of said housing, said restricting means further comprising means for urging said pin into said first position for normally preventing rotation of said housing.

15. A mechanism as recited in claim 10 wherein said housing is formed with a slot extending radially from said shaft, wherein said securing means comprise a body slidably received in said slot, said plunger being slidably received in said body, and wherein said urging means comprise a spring urging said body into engagement with the splined portion of said shaft and second means for urging said plunger toward said shaft, said second urging means being located in said body.

16. A mechanism as recited in claim 15 further comprising a scale secured to said housing and having graduations, and wherein said housing further includes a second slot, said second slot being parallel to said first slot and adjacent said body whereby said body is visible through said second slot, the major diameter of said splines being visually indicated by the graduation that aligns with said body when said body is in engagement with said splines.

17. A mechanism as recited in claim 15 wherein said housing is formed with a wall adjacent said shaft, said wall being located oppositely of said body with respect to said shaft, and wherein said spring engages said housing and is located outwardly of said body with respect to said shaft whereby said spring draws said wall into engagement with said shaft as said spring urges said body into engagement with said shaft.

18. A mechanism as recited in claim 10 wherein said urging means comprise a first spring normally separating said electrical contact surfaces, said urging means further comprising a second spring connected to said second electrical contact surface, said second spring urging said first electrical contact surface toward said shaft when said electrical contact surfaces are engaging.

19. A mechanism as recited in claim 18 further comprising a casing engaging said shaft, a contact cap, and means for rotatably securing said casing and said contact cap for rotation with said housing while permitting said casing and said contact cap to move radially of said shaft, said second electrical contact surface being secured to said contact cap, wherein said second spring normally urges said contact cap into engagement with said casing so as to establish a predetermined distance between said second electrical contact surface and the crowns of said splines whereby said contact cap is radially moveable with said casing so as to maintain said predetermined distance independently of the major diameter of said splines.

20. A mechanism as recited in claim 19 wherein the length of said plunger is greater than said predetermined distance.

21. A mechanism for counting the number of angularly spaced splines on a shaft, said mechanism comprising a housing, means for rotating said housing with respect to said shaft, means for normally locking said housing in a predetermined position with respect to said shaft whereby said housing is normally prevented from rotating relative to said shaft, means for releasing said locking means whereby said housing may be freely rotated through one revolution whereupon said locking means automatically re-locks, said housing being formed with a slot extending radially from said shaft, a body slidably located in said slot, said body having an opening extending radially with respect to said shaft and having a backwall formed at the end of said opening to define a cavity internally of said body, a casing slidably received in said opening, said casing having a first end and a flange located in said cavity, said first end extending beyond said body and engaging the crowns of said splines, said casing further having an opening formed in said first end and extending radially of said shaft, a plunger slidably received in said opening in said casing, said plunger having a first end extending beyond said first end of said casing and having a second end, said plunger being movable radially of said shaft between inner and outer positions, said plunger being in said inner position when said first end of said plunger is located angularly between two adjacent splines and being in said outer position when said first end of said plunger is in contact with the crown of a spline, a contact cap located in said cavity, said contact cap having a flange capable of engaging said casing, an electrical circuit having a first electrical contact surface defined at said second end of said plunger and a second electrical contact surface connected to said contact cap, said contact surfaces engaging when said plunger is in said outer position and separating when said plunger is in said inner position, said contact surfaces establishing electrical continuity in said electrical circuit when said contact surfaces engage, a first spring located between and engaging said plunger and said contact cap and normally separating said electrical contact surfaces, said first spring normally urging said plunger toward said inner position whereby each spline drives said plunger to said outer position as the first end of said plunger engages each spline when said housing is rotated, a second spring normally urging said flange of said contact cap into engagement with said casing so as to normally urge said casing toward said shaft and establish a predetermined distance between said second electrical contact surface and the crowns of said splines independent of the major diameter of said splines, the length of said plunger being greater than said predetermined distance whereby said plunger separates said contact cap from said casing when said plunger is in said outer position, a third spring urging said body into engagement with said shaft, and means for counting and displaying the number of times electrical continuity is established between said electrical contact surfaces whereby the number of times electrical continuity is established as said housing travels through one revolution is equal to the number of splines on said shaft.

22. A mechanism as recited in claim 21 wherein said housing is formed with a wall adjacent said shaft, said wall being located oppositely of said body with respect to said shaft, and wherein said third spring engages said housing and said body and is located outwardly of said body with respect to said shaft whereby said spring further draws said wall into engagement with said shaft.

* * * * *